US008701975B2

(12) United States Patent
Farris

(10) Patent No.: US 8,701,975 B2
(45) Date of Patent: Apr. 22, 2014

(54) APPARATUS AND SYSTEM FOR A SELF-ATTACHING CONTAINER

(76) Inventor: Norma Farris, Lehi, UT (US)

( * ) Notice: Subject to any disclaimer, the term of this patent is extended or adjusted under 35 U.S.C. 154(b) by 365 days.

(21) Appl. No.: 13/023,525

(22) Filed: Feb. 8, 2011

(65) Prior Publication Data

US 2011/0192891 A1 Aug. 11, 2011

Related U.S. Application Data

(60) Provisional application No. 61/302,496, filed on Feb. 8, 2010.

(51) Int. Cl.
*B65D 43/22* (2006.01)

(52) U.S. Cl.
USPC ..... 229/125.39; 229/155; 220/315

(58) Field of Classification Search
USPC ..... 229/125.37, 125.39, 155; 220/315, 323, 220/324, 826, 833, 834, 646, 650, 62
See application file for complete search history.

(56) References Cited

U.S. PATENT DOCUMENTS

| | | | | | |
|---|---|---|---|---|---|
| 933,454 | A * | 9/1909 | Hudson | 229/125.39 |
| 2,256,834 | A * | 9/1941 | Mandel | 229/125.39 |
| 3,545,801 | A * | 12/1970 | Barsness | 292/288 |
| 4,296,524 | A * | 10/1981 | Horholt et al. | 16/225 |
| 4,670,938 | A * | 6/1987 | Fowlston | 16/225 |
| 5,624,070 | A * | 4/1997 | Gueniot | 229/155 |
| 5,743,461 | A | 4/1998 | Timmins | |
| 6,003,203 | A * | 12/1999 | Fowlston | 16/225 |
| 6,045,037 | A * | 4/2000 | McGeehin | 229/125.39 |
| 6,223,400 | B1 * | 5/2001 | Lenack | 24/306 |
| 6,230,965 | B1 * | 5/2001 | Dismukes | 229/125.39 |
| 6,290,126 | B1 * | 9/2001 | Zudal | 229/125.39 |
| 6,571,538 | B2 | 6/2003 | Luby | |
| 6,899,946 | B2 | 5/2005 | Geary et al. | |
| 7,160,029 | B2 | 1/2007 | Bein et al. | |
| 7,284,688 | B1 * | 10/2007 | Barsness et al. | 229/125.39 |
| 7,854,372 | B1 * | 12/2010 | Bartone, Sr. | 229/125.39 |
| 2001/0002678 | A1 * | 6/2001 | Luby | 229/125 |
| 2007/0131751 | A1 * | 6/2007 | Rutledge | 229/148 |
| 2011/0111517 | A1 * | 5/2011 | Siegel et al. | 436/164 |

FOREIGN PATENT DOCUMENTS

| | | |
|---|---|---|
| JP | 7004181 | 2/1995 |

OTHER PUBLICATIONS

International Search Report and Written Opinion, App No. PCT/US2011/024110, Oct. 6, 2011.

* cited by examiner

*Primary Examiner* — Gary Elkins
*Assistant Examiner* — Scott McNurlen
(74) *Attorney, Agent, or Firm* — Kunzler Law Group

(57) ABSTRACT

A support mechanism for a container includes a container coupling mechanism, a flap overlap mechanism and an attachment mechanism. The container coupling mechanism is configured to couple to a distal end of a first flap of the container. The flap overlap mechanism is configured to overlap a second flap of the container when the first flap and the second flap are in a closed position, such that the second flap is between an interior portion of the container and the flap overlap mechanism in the closed position. The attachment mechanism is configured to selectively maintain the first flap and the second flap in the closed position. The support mechanism supports a greater force applied in a direction normal to a plane formed by the first flap and second flap in the closed position than a force supported by the first flap and the second flap without the support mechanism.

16 Claims, 7 Drawing Sheets

APPARATUS AND SYSTEM FOR A SELF-ATTACHING CONTAINER

CROSS-REFERENCES TO RELATED APPLICATIONS

This application claims the benefit of U.S. Provisional Patent Application No. 61/302,496 entitled "Systems and Methods for Providing a Self-Attaching Container" and filed on Feb. 8, 2010 for Norma Farris, which is incorporated herein by reference.

FIELD OF THE INVENTION

This invention relates to container closing apparatus, systems, and methods and more particularly relates apparatus, systems, and methods for re-attachable containers.

BACKGROUND

Storage and moving techniques include using cardboard boxes when storing or transporting items. For example, when a person moves from one home to another, the person typically gathers or purchases cardboard boxes for packing. Bottom flaps of each box are taped to cause the box to be able to contain items within the box. The box is filled with household or personal items that are being moved to the new home. The top flaps are then taped to secure the box. The filled box is moved to the new home. Unpacking of the box includes removal of the tape, which can require a knife or other tool and which can tear the outer surface of the box and reduce the integrity of the box. The items are removed and the box can be thrown away, or the cardboard may be recycled.

At times a cardboard box is used for storage. Similarly, the bottom flaps of a box are taped to cause the box to be able to contain items for storage. The box is filled with the items for storage. The top flaps are then taped to secure the box. At times, only one or more items in a box are desired to be retrieved while the remaining portion is kept in storage. In such a case an individual must remove tape, remove the one or two items from the box and retain the box. Repeated access to a box in this manner may cause the box to weaken or tear.

SUMMARY

From the foregoing discussion, it should be apparent that a need exists for a support mechanism and related system that supports a container. Beneficially, such an apparatus, system, and method would provide additional support to a container while operating as a closure mechanism for repeated openings and closings of the container.

The present invention has been developed in response to the present state of the art, and in particular, in response to the problems and needs in the art that have not yet been fully solved by currently available support mechanisms. Accordingly, the present invention has been developed to provide a support mechanism and related systems that overcome many or all of the above-discussed shortcomings in the art.

The support mechanism for a container, in one embodiment, includes a container coupling mechanism for coupling to a distal end of a first flap of the container. The container includes at least a first flap and a second flap where the first flap and the second flap each include a hinge end and the distal end opposite the hinge end. The hinge end of the first flap is connected to a first side of the container and the hinge end of the second flap is connected to a second side of the container. The container coupling mechanism extends substantially along the distal end of the first flap from a third side of the container to a fourth side of the container. The third side and the fourth side are perpendicular to the first side and the second side of the container. The first side, the second side, the third side, and the fourth side are connected to form a rectangle or a square.

The support mechanism, in one embodiment, includes a flap overlap mechanism that overlaps the second flap when the first flap and the second flap are in a closed position such that the second flap is between an interior portion of the container and the flap overlap mechanism in the closed position. The support mechanism, in one embodiment, includes an attachment mechanism that selectively maintains the first flap and the second flap in the closed position. The support mechanism supports a greater force applied in a direction normal to a plane formed by the first flap and second flap in the closed position than a force supported by the first flap and the second flap without the support mechanism.

In one embodiment, the container coupling mechanism and the flap overlap mechanism are made of one piece monolithic construction. In other embodiments, the attachment mechanism may include one or more of a hook and loop fastener, a resistive fit mechanism, an adhesive, a button, and a magnet. In another embodiment, the support mechanism includes materials different from materials of the container. In yet another embodiment, the support mechanism is coupled to the first flap after manufacturing of the container. In another example, the container coupling mechanism includes a channel for securing the coupling mechanism to the distal end of the first flap. In further embodiments, the container coupling mechanism includes one or more of an adhesive, an adhesive strip, a hook and loop fastener, and a series of posts that extend through a flap of the container.

In one embodiment, the attachment mechanism includes a first piece for coupling to the first flap and a second piece for coupling to the second flap. In another embodiment, the attachment mechanism includes a resistive fit between the first piece and the second piece. In another embodiment, the first piece includes a first portion shaped to receive a second portion of the second piece in a closed position and the closed position is resistive to opening. In a further embodiment, the attachment mechanism includes a hook and loop fastener, a magnet and material attractive to the magnet, and/or a snap. In another embodiment, the first portion includes a lip that overlaps the second portion and the second portion includes a recess and the lip is shaped to fit in the recess to form a resistive fit in a closed position. In further embodiments, the support mechanism may include plastic, rubber, metal, and/or vinyl. In yet another embodiment, one or both of the container coupling mechanism and the flap overlap mechanism include a writeable surface A container system of the present invention is also presented to provide support for a container. In particular, the container system, in one embodiment, includes a container with at least a first flap and a second flap. The first flap and the second flap each include a hinge end and a distal end opposite the hinge end. The hinge end of the first flap is connected to a first side of the container and the hinge end of the second flap is connected to a second side of the container. A third side and a fourth side are perpendicular to the first side and the second side of the container. The first side, the second side, the third side, and the fourth side are connected to form a rectangle or a square. The container system, in one embodiment, includes a container coupling mechanism for coupling to the distal end of the first flap of the container. The container coupling mechanism extends substantially along the distal end of the first flap from the third side of the container to the fourth side of the container.

The container system, in one embodiment, includes a flap overlap mechanism overlapping the second flap when the first flap and the second flap are in a closed position such that the second flap is between an interior portion of the container and the overlap mechanism in the closed position. The container system, in another embodiment includes an attachment mechanism that selectively maintains the first flap and the second flap in the closed position. The support mechanism supports a greater force applied in a direction normal to a plane formed by the first flap and second flap in the closed position than a force supported by the first flap and the second flap without the support mechanism. In one embodiment, the container coupling mechanism, the flap overlap mechanism, and the attachment mechanism are of a one piece monolithic construction for coupling to the first flap and a second piece for coupling to the second flap.

A container support kit is described and includes a support mechanism. The support mechanism, in one embodiment, includes a container coupling mechanism for coupling to a distal end of a first flap of the container. The container includes at least a first flap and a second flap where the first flap and the second flap each include a hinge end and the distal end opposite the hinge end. The hinge end of the first flap is connected to a first side of the container and the hinge end of the second flap is connected to a second side of the container. The container coupling mechanism extends substantially along the distal end of the first flap from a third side of the container to a fourth side of the container. The third side and the fourth side are perpendicular to the first side and the second side of the container. The first side, the second side, the third side, and the fourth side are connected to form a rectangle or a square.

The support mechanism, in one embodiment, includes a flap overlap mechanism that overlaps the second flap when the first flap and the second flap are in a closed position such that the second flap is between an interior portion of the container and the flap overlap mechanism in the closed position. The support mechanism, in one embodiment, includes an attachment mechanism that selectively maintains the first flap and the second flap in the closed position. The container support kit, in one embodiment, includes instructions for connecting the support mechanism to the container. The support mechanism supports a greater force applied in a direction normal to a plane formed by the first flap and second flap in the closed position than a force supported by the first flap and the second flap without the support mechanism.

In one embodiment, the attachment mechanism includes a first piece coupled to the flap overlap mechanism and a second piece for coupling to the second flap. The first piece and the second piece are part of the attachment mechanism. The first piece is shaped to attach to the second piece to maintain the first flap and the second flap in the closed position. In another embodiment, the container support kit includes a hook and loop fastener.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced with or without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

A container support mechanism in accordance with one or more embodiments of the present invention enables for the opening, closing, reopening and reclosing of a container without compromising the integrity of the container.

Figure 1A:
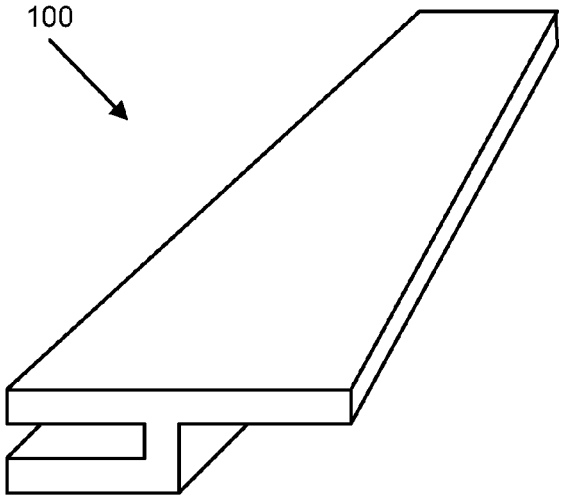
FIG. 1A is a perspective view illustrating one embodiment of a container support mechanism in accordance with the present invention.
Figure 1B:
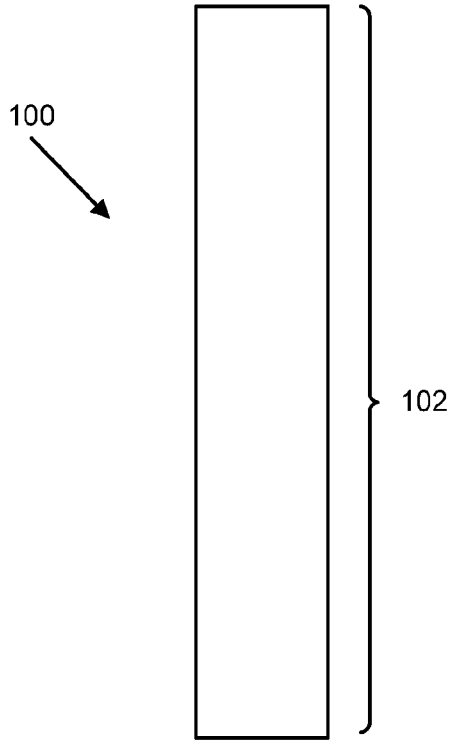
FIG. 1B is a top view of the exemplary container support mechanism of FIG. 1A.
Figure 1C:
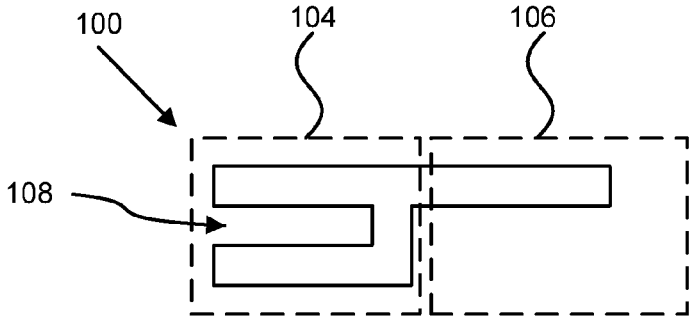
FIG. 1C is a cross-sectional side-view of the exemplary container support mechanism of FIG. 1A.

FIGS. 1A-1C illustrate one exemplary embodiment of a support mechanism 100 in accordance with the present invention. FIG. 1A is a perspective side view of the support mechanism 100 and illustrates the cross-sectional structure as well as the length of the support mechanism 100.

FIG. 1B is a top view of the support mechanism 100. FIG. 1B illustrates a length 102 of the support mechanism 100. According to one embodiment, the length 102 corresponds substantially to the length of a container. In some embodiments, the length 102 may vary considerably. For example, some embodiments may have a length 102 corresponding to one container size while other embodiments may have a length 102 corresponding to a smaller or larger container size. The length 102 may also be extremely long such that the support mechanism 100 may be cut according to a desired length 102. For example, a support mechanism 100 may be part of a container support kit and may have a length 102 much greater than that of most containers or boxes, for example ten feet. An end user may be able to cut the support mechanism 100 along its length 102 to create multiple support mechanisms 100 for a plurality of containers.

FIG. 1C is a side view of the support mechanism 100 and illustrates an exemplary cross-sectional shape of the support mechanism 100. According to the depicted embodiment, the support mechanism 100 includes a container coupling portion 104 and a flap overlap portion 106. The container coupling portion 104 includes a container coupling mechanism, depicted as a channel 108 in this embodiment, for coupling to a flap of a container.

The flap overlap portion 106 includes a flap overlap mechanism for overlapping another flap of a container. For example, a coupling mechanism of the container coupling portion 104 may be used to couple to a first flap of a container and while the flap overlap mechanism of the flap overlap portion 106 may be used to overlap a second flap of a container. According to one embodiment, the flap overlap portion 106 overlaps another flap such that the other flap is retained between the overlap portion 106 and the interior of a container.

The support mechanism 100 of FIGS. 1A-1C is exemplary only and can vary considerably. For example, exemplary variations are depicted in FIGS. 8A-8D, 9A-9D, and 10A-10D and will be discussed later. In addition, the support mechanism 100 may include attachment mechanism for securing one flap of a container to another flap. For example, see FIGS. 4, 5, 6, 9A, 9B, 10A, and 10B.

Figure 2:
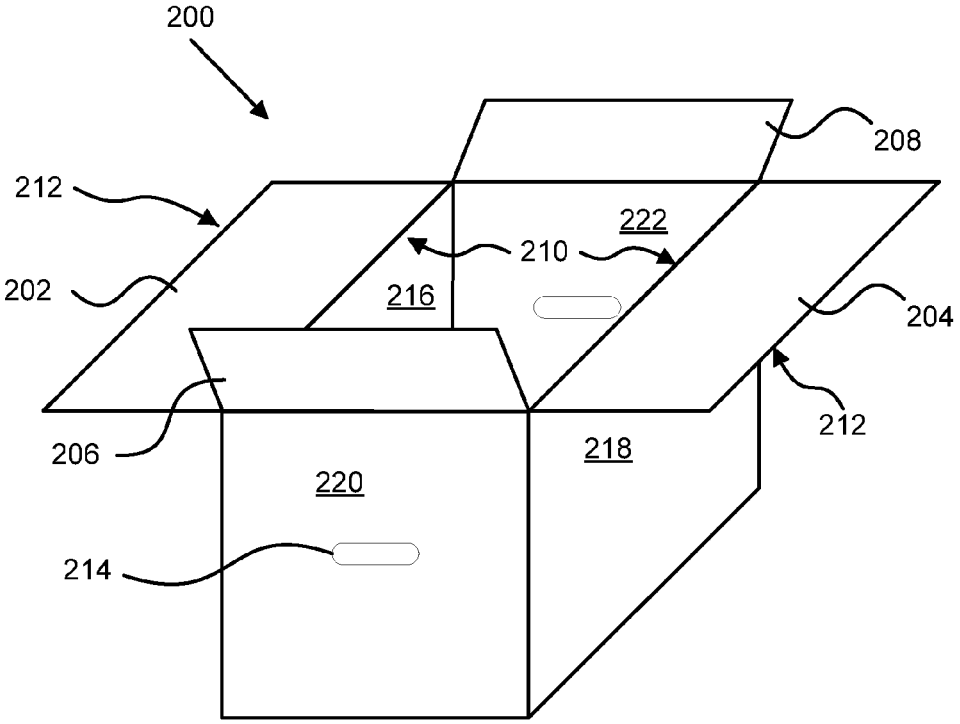
FIG. 2 is a perspective view illustrating one embodiment of a container in accordance with the present invention.

FIG. 2 is a perspective view of an exemplary container 200 to which the support mechanism 100 of FIGS. 1A-1C may be attached. The container 200 includes a first flap 202, a second flap 204, a third flap 206, and a fourth flap 208. The container 200 may also include one or more handles 214. Each of the flaps has a hinge end 210 that attaches to one of the sides of the container 200 and a distal end 212 opposite the hinge end. For example, the first flap 202 includes a hinge end 210 connected to a first side 216 of the container 200, around which the first flap 202 may be rotated, and a distal end 212 opposite the hinge end 210. Similarly, the second flap 204 includes a hinge end 210 connected to a second side 218 of the container 200, around which the second flap 204 may be rotated, and a distal end 212 opposite the hinge end 210. The container 200 includes a third side 220 and a fourth side 222 which are perpendicular to the first and second sides 216, 218. The container coupling mechanism 104 extends substantially along the distal end 212 of the first flap 202 from the third side 220 of the container 200 to the fourth side 222 of the container 200. The first side 216, the second side 218, the third side 220, and the fourth side 222 are connected to form a rectangle or a square.

Hereinafter "substantially along" the distal end 212 includes a container coupling mechanism 104 that is exactly the same distance from the third side 220 to the fourth side 222. Likewise, "substantially along" the distal end 212 includes a container coupling mechanism 104 that is slightly shorter than the distance from the third side 220 to the fourth side 222, and includes a container coupling mechanism 104 that is slightly longer than the distance from the third side 220 to the fourth side 222. For example, a container coupling mechanism 104 that is about the same length 102 as the distal end 212 of the first or second flap 202, 204 is anticipated herein. One of skill in the art will recognize that a container coupling mechanism 104 that differs slightly from the exact distance from the third side 220 to the fourth side 222 will function equivalently to a container coupling mechanism 104 exactly the distance from the third side 220 to the fourth side 222.

The container 200 may be made of a variety of materials. According to one embodiment, the container 200 may be made primarily of cardboard, such as corrugated cardboard boxes well known in the art. Other embodiments of containers 200 may be made of other materials such as plastic, rubber, metal, or any other material.

Figure 3A:
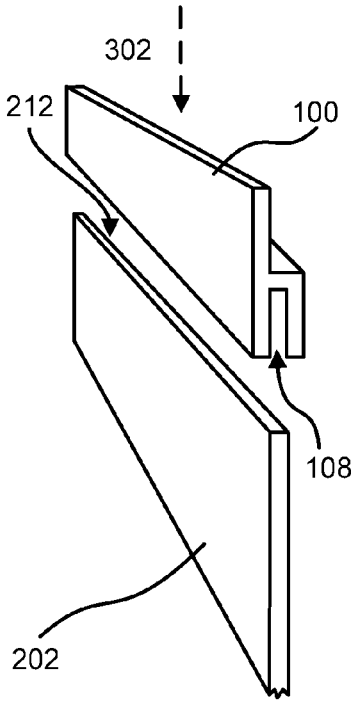
FIGS. 3A and 3B are perspective views illustrating one embodiment of coupling the support mechanism of FIG. 1A to the container of FIG. 2, in accordance with the present invention.
Figure 3B:
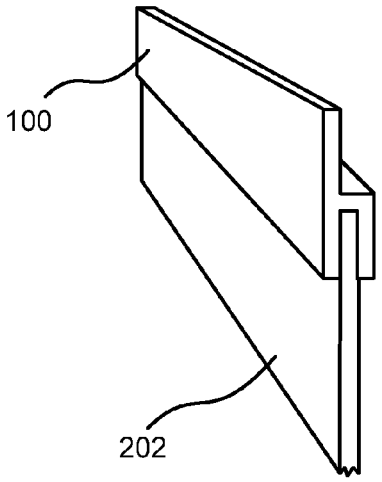

FIGS. 3A and 3B show cut-away side views illustrating the coupling of the support mechanism 100 of FIGS. 1A-1C to the distal end 212 of the first flap 202 of FIG. 2, according to one embodiment. With regard first to FIG. 3A, the first flap 202 is illustrated in a vertical position. The support mechanism 100 is oriented such that the channel 108 is aligned with the first flap 202. The support mechanism 100 is moved in a direction indicated by arrow 302 such that the channel 108 receives the distal end 212 of the first flap 202.

FIG. 3B illustrates the support mechanism 100 and first flap 202 after they have been coupled, as described with regard to FIG. 3A. The distal end 212 of the first flap 202 is shown within the channel 108 of the support mechanism 100. According to one embodiment, the support mechanism 100 may be retained on the first flap 202 in a variety of different manners. According to one embodiment an adhesive is placed between the distal end 212 of the first flap 202 and the interior surface or surfaces of the channel 108 of the support mechanism 100. Exemplary adhesives may include glue, an adhesive strip, such as double sided tape, or any other adhesive or form of attachment. According to one embodiment, the interior of the channel 108 includes an adhesive covered by a removable piece of material, such as paper. The paper may be removable prior to insertion of a distal end 212 of a flap (e.g. 202). The adhesive then may retain the distal end 212 of the flap (e.g. 202) within the channel 108 after coupling.

According to another embodiment, the channel 108 may include a resistive fit with the distal end 212 of a flap (e.g. 202). For example, the channel 108 may have a width narrower than a width of the first flap 202 such that it squeezes the distal end 212 of the first flap 202 after insertion. This may maintain position of the first flap 202 within the channel 108. According to one embodiment, the channel 108 may include a high friction surface such that a substantial amount of force is required to remove the support mechanism 100 after it has been coupled to a flap. According to one embodiment, the channel 108 may include a surface that provides high friction in one direction but low friction in an opposite direction. For example, the surfaces of the channel 108 may provide low friction when the first flap 202 is being inserted into the channel 108 but high friction when a force is applied to remove the distal end 212 of the first flap 202 from the channel 108. In one example, teeth ridges, or the like within the channel 108 may be used to provide this one-way friction surface.

With the support mechanism 100 mounted on the first flap 202 the first flap 202 may be better able to resist creasing and tearing of the flap. For example, when opening or closing the container 200 the flaps 202-208 are often manipulated. At times, a sufficient amount of force may be applied to a flap to cause it to crease and/or tear, weakening the container 200. With the support mechanism 100 attached, it may be more difficult to weaken the flaps.

Figure 4:
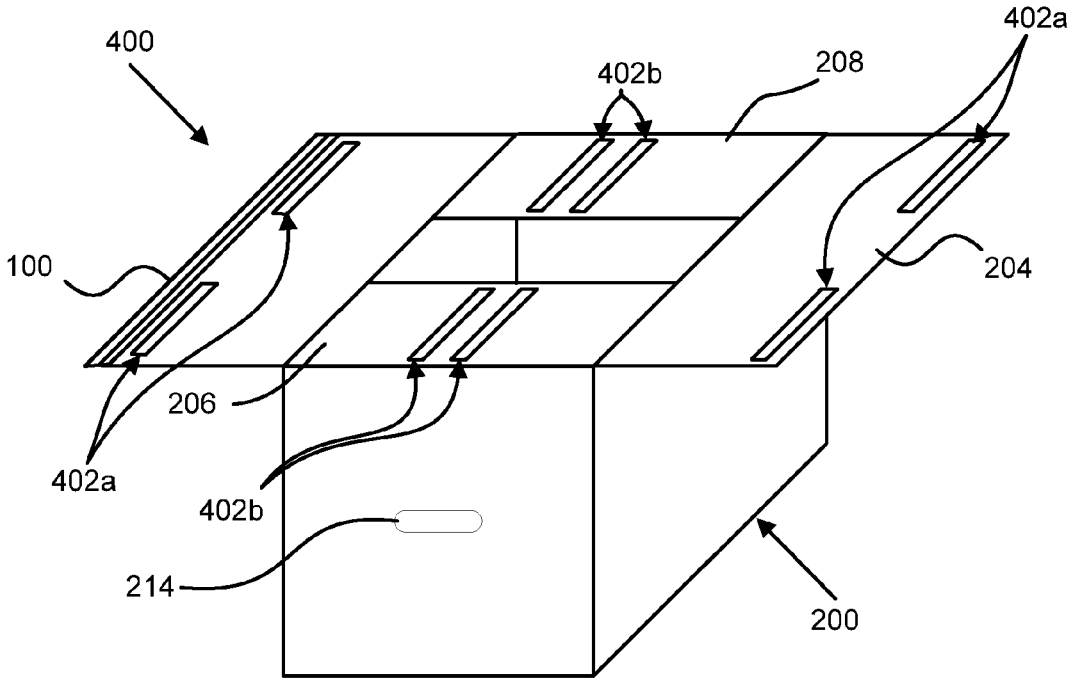
FIG. 4 is a perspective view illustrating one embodiment of a container system with flaps in an open position in accordance with the present invention.

FIG. 4 illustrates a container system 400. The container system 400 includes a container 200, a support mechanism 100, and one embodiment of an attachment mechanism 402. The first flap 202 and the second flap 204 are illustrated in an open position. According to one embodiment, the container system 400 provides a self-attaching container 200 that can be selectively opened and closed. According to one embodiment, a support mechanism includes the support mechanism 100 and the attachment mechanism 402. The container system 400 may also include a reinforced handle 214.

The support mechanism 100 is depicted coupled to the first flap 202 as described in relation to FIGS. 3A and 3B. The attachment mechanism 402 includes a plurality of mechanisms 402*a*-402 for attaching one or more flaps to one or more other flaps. In the depicted embodiment the attachment mechanism 402 includes a plurality of first attachment portions 402*a* and a plurality of second attachment portions 402*b*. Specifically, the first attachment portions 402*a* and second attachment portions 402*b* are depicted as portions of hook and loop fasteners. For example, the first attachment portions 402*a* may include hook portions of a hook and loop fastener while the second attachment portions 402*b* may include loop portions of a hook and loop fastener. Other embodiments may include snaps, clips, or other mechanism to attach the flaps 202-208. In addition, magnets or another attractive mechanism may be used. For example, a first attachment portion 402*a* may include a magnet and a second attachment portion 402*b* may include a material attractive to a magnet, such as a magnet of opposite polarity, metal, etc. One of skill in the art will recognize other material suitable for the attachment mechanism 402 that will maintain flaps 202-208 in a closed position.

The first attachment portions 402*a* and the second attachment portions 402*b* may be mounted on the flaps 202-208 in a variety of manners. According to one embodiment, they are mounted using an adhesive. In other embodiments, they are mounted using staples or any other mounting method.

In the depicted embodiment, the plurality of portions 402*a*-402*b* of the attachment mechanism 402 are placed on different flaps such that the different flaps may be selectively attached to each other. Specifically, the plurality of first attachment portions 402*a* are placed on the first flap 202 and the second flap 204 while the second attachment portions 402*b* are placed on the third flap 206 and fourth flap 208. According to one embodiment, the first attachment portions 402*a* engage and are engaged by the second attachment portions 402*b* to attach the respective flaps to each other. For example, the attachment mechanism 402*a*-402*b* may be used to selectively attach the second flap 204 to the third flap 206 and the fourth flap 208. Similarly, the first flap 202 may be selectively attached to the third flap 206 and the fourth flap 208.

As will be understood by one skilled in the art in light of the present disclosure, the placement of the attachment mechanism 402*a*-402*b* is exemplary only. Considerable variation in placement is possible. Additionally considerable variation in the type of attachment mechanism is possible. For example, the attachment mechanism 402*a*,402*b* may include other types of fasteners such as a hook and loop fastener, one or more buttons, one or more resistive fit mechanisms, one or more magnets, a re-attachable adhesive, or any other material that would cause multiple surfaces to adhere together and to be selectively reattached. The attachment mechanism 402*a*, 402*b* may be arranged in any manner.

Additionally, embodiments of the present invention embrace support mechanisms 100 that comprise a variety of different materials. Examples include plastic, rubber, metal, vinyl, or any other material that would provide structural integrity to the container 200.

In a further embodiment of a container system 400, an insert (not shown) is provided that corresponds to the sides of the container 200 and includes surfaces or devices for supporting hanging files that are selectively inserted within the container 200. In another embodiment, corresponding channels are provided on corresponding walls of the container 200, the channels being configured to receive at least a portion of hanging files that are selectively inserted into the container 200 in order to support the hanging files. In a further embodiment, the surfaces for supporting hanging files comprise a material that allows the hanging files to slide thereon. By way of example, the material comprises a polymer or any other material to enable the hanging files to slide thereon.

Figure 5:
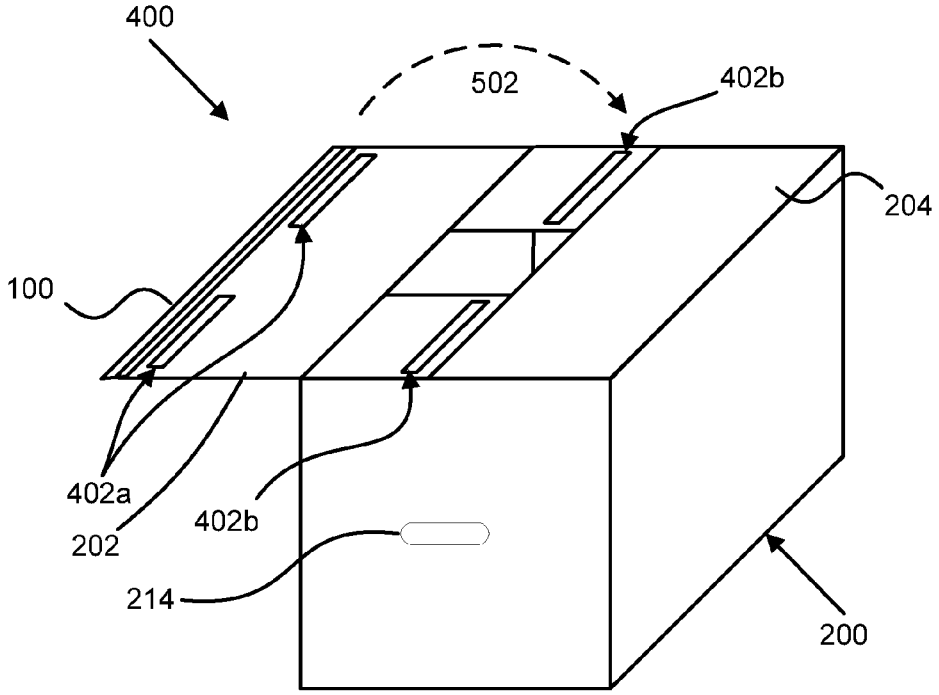
FIG. 5 is a perspective view illustrating one embodiment of a container system with some flaps in a closed position in accordance with the present invention.

FIG. 5 illustrates the container system 400 of FIG. 4 with the second flap 204 in a closed position and the first flap 202 in an open position. According to one embodiment, the first attachment portions 402*a* on the second flap 204 have been attached to two of the second attachment portions 402*b* and maintains the second flap 204 in contact with the third flap 206 and the fourth flap 208. The remaining two second attachment portions 402*b* are available for attachment to the first attachment portions 402*a* on the first flap 202.

Arrow 502 depicts an exemplary path along which the distal end 212 of the first flap 202 may be moved from an open position to a closed position. In one embodiment, the second flap 204 is manipulated in to a closed position before the first flap 202 so that the overlap portion 106 of the support mechanism 100 can overlap a distal end 212 of the second flap 204. This will be illustrated and discussed in relation to later figures.

It should be noted that while the support mechanism 100 and attachment mechanism 402 are shown on flaps on the top side of the container 200 they may be alternatively or additionally used on bottom flaps of a container 200, or on both top and bottom flaps of the container 200.

Figure 6A:
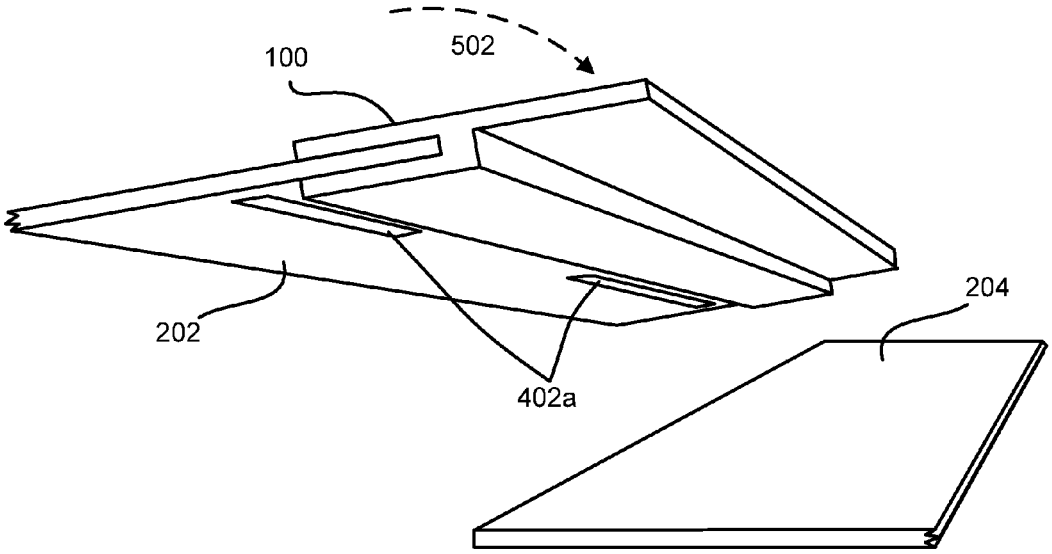
FIGS. 6A and 6B are cutaway perspective views illustrating varying embodiments of attachment mechanisms and the closing of flaps in accordance with the present invention.
Figure 6B:
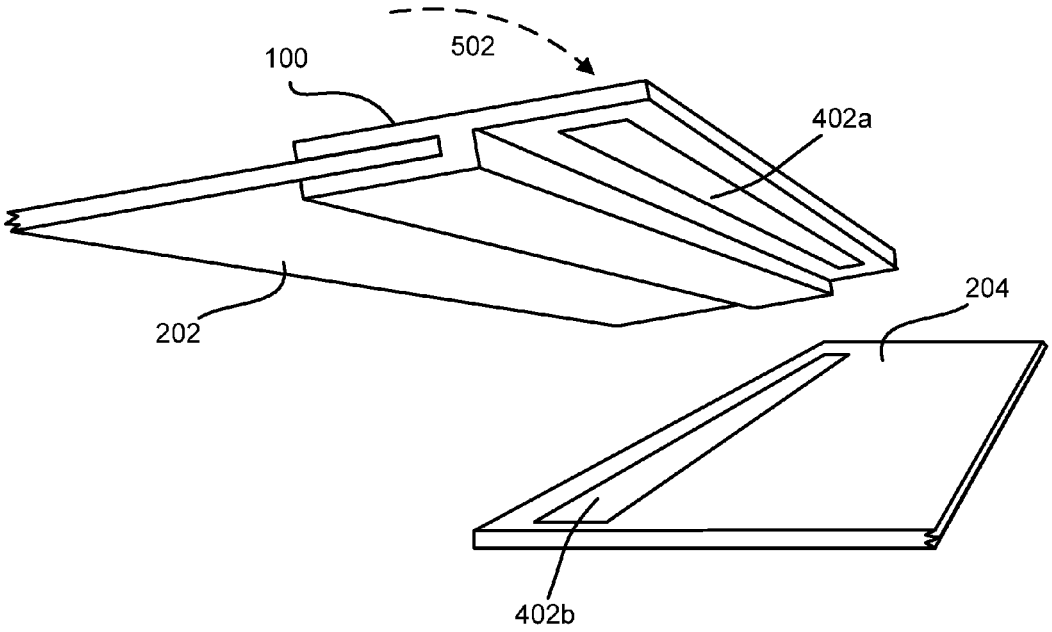

FIGS. 6A and 6B illustrate cutaway side views of the first flap 202 and second flap 204 as the first flap 202 is being moved in the direction of arrow 502 towards a closed position, according to varying embodiments. FIG. 6A illustrates the first flap 202 and second flap 204 of the container system 400 of FIGS. 4 and 5 as the first flap 202 is being moved in the direction of arrow 502 towards a closed position. The first attachment portions 402*a* are depicted and may be received by one or more second attachment portions 402*b* (not shown) when the first flap 202 reaches a closed position. Similarly, the second flap 204 may include first and second attachment portions 402*a*, 402*b* (not shown).

FIG. 6B illustrates a portion of an alternate embodiment of a container system 400 as the first flap 202 is being moved in the direction of arrow 502 towards a closed position. In the alternate embodiment of FIG. 6B the attachment mechanism 402 is shown mounted in a different manner. Specifically, a first portion of the attachment mechanism 402*a* is mounted on the overlap portion 106 of the support mechanism 100 rather than on the first flap 202. The second portion of the attachment mechanism 402*b* is mounted near the distal end 212 of the second flap 204 such that the two portions attach when the first flap 202 and the second flap 204 are in a closed position. According to one embodiment, the placement of the attachment mechanism 402 as depicted in FIG. 6B may be preferred. In one embodiment, it may require fewer separate pieces to attach. For example, rather than attaching the eight separate pieces depicted in FIG. 4, only two pieces may be needed in the embodiment of FIG. 6B. In another embodiment, the support mechanism 100 includes first and second attachment mechanisms 402*a*, 402*b* as depicted in FIGS. 4 and 5 as well as first and second attachment mechanisms 402*a*, 402*b* as depicted in FIG. 6B.

Figure 7A:
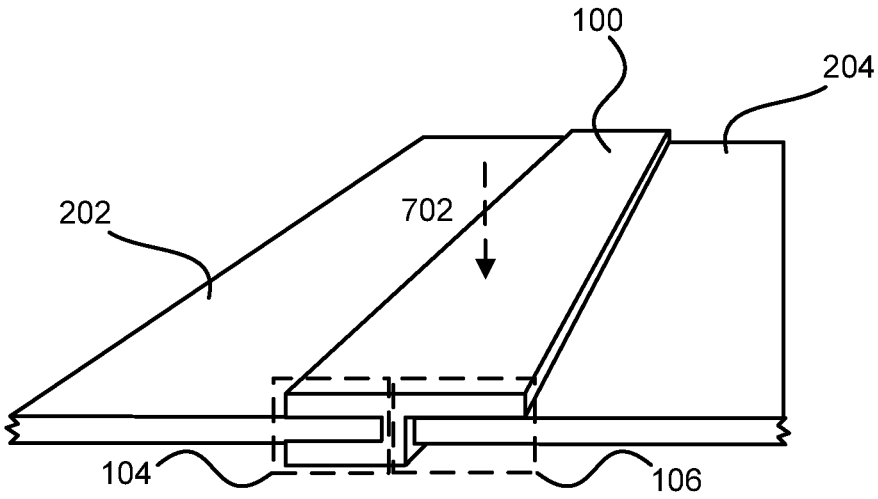
FIG. 7A is a cutaway perspective view of one embodiment of a support mechanism and flaps in a closed position in accordance with the present invention.
Figure 7B:
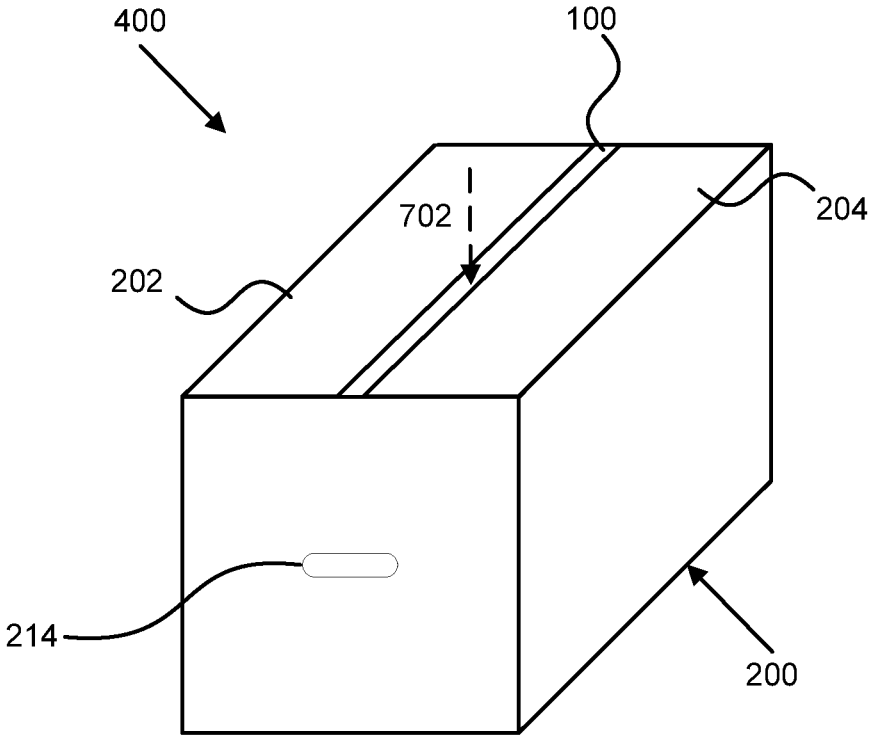
FIG. 7B is a cutaway perspective view of one embodiment of a container system with flaps in a closed position in accordance with the present invention.

Turning now to FIGS. 7A and 7B, the first flap 202 and the second flap 204 are depicted in a closed position. FIG. 7A is a cutaway side view of the first flap 202 and the second flap 204 and the support mechanism 100. The container coupling mechanism 104 of the support mechanism 100 is shown coupled to the first flap 202. The flap overlap portion 106 of the support mechanism 100 is shown overlapping the second flap 204.

FIG. 7B is a perspective view of the container system 400 with the first flap 202 and the second flap 204 in a closed position. Arrow 702 illustrates a direction normal to the plane formed by the first flap 202 and the second flap 204. According to one embodiment, the support mechanism 100 mounted to the container 200 may provide additional structural support in the direction of the arrow 702. The container 200 may therefore be able to support more weight with the use of the support mechanism 100 than without the support mechanism 100. Additionally, the support mechanism 100 may provide support to keep the flaps from being weakened through bending or tearing.

The exemplary support mechanisms 100, the attachment mechanisms 402 and their uses as depicted in FIGS. 1A-7B may provide significant utility and benefits. Exemplary benefits may include a self attaching container 200 that may be selectively closed and opened. According to one embodiment, providing a support mechanism 100 may be cheaper than bankers boxes or other boxes made for repeated opening and closing because the support mechanism 100, may be in the form of a container support kit or system, may be added to a normal cardboard box. Additionally, the life of a cardboard box may be extended due to decrease of bending and/or tearing of flaps. Additionally, the support mechanism 100 may be reusable in some embodiments. Also, the overlap portion 106 may reduce the amount of dirt, dust, debris or other objects that may fall into a box during moving and/or storing.

The support mechanism 100 may also be used as a writing surface for labeling the contents of a container 200. In one embodiment, a writeable and/or erasable surface is provided on the support mechanism 100. Upon the writeable and/or erasable surface, the user is able to selectively record or label the container 200. This facilitates identification of the contents in the container 200. When the contents change, the user is able to selectively erase and correctly label the container 200.

Figure 8A:
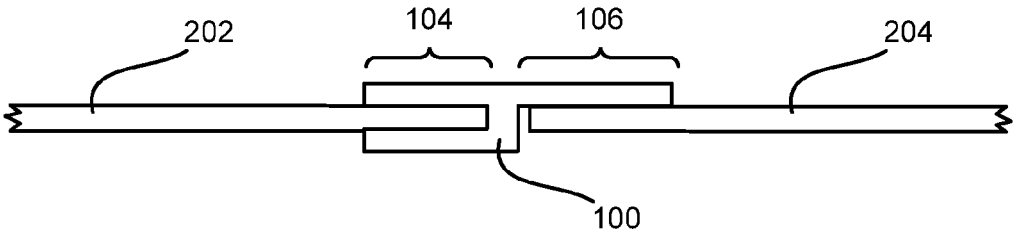
FIGS. 8A-8D are cross-sectional side-views of varying embodiments of support mechanisms and flaps in accordance with the present invention.

FIGS. 8A through 8D illustrate exemplary variations in the cross sectional shape of the support mechanism 100 in a closed position. FIG. 8A illustrates a support mechanism 100 having the same cross-sectional shape as displayed in FIGS. 1A-1C. The support mechanism 100 includes a coupling mechanism 104 and an overlap portion 106. The container coupling mechanism 104 includes a channel 108 coupled to a first flap 202 and the overlap portion 106 includes a flap overlap mechanism that overlaps a second flap 204. The support mechanism 100 may also include an attachment mechanism, such as a hook and loop fastener between the overlap portion 106 and the second flap 204.

Figure 8B:
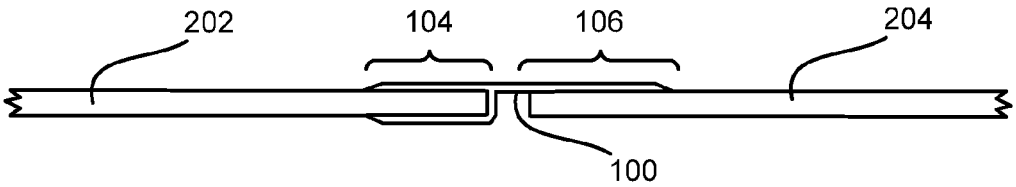

FIG. 8B illustrates a support mechanism 100 having a similar cross sectional shape as displayed in FIGS. 1A-1C. However, the support mechanism 100 is thinner and depicted with beveled edges. According to one embodiment, the thickness of the support mechanism 100 may be varied according to the type of material from which the support mechanism 100 is made, the amount of strength which is needed, a desired weight of the support mechanism 100, or any other consideration. The beveled edges of the support mechanism 100 may provide an aesthetically pleasing device and container system 400 and/or may reduce sharp edges or bumps on a container 200.

Similar to the support mechanism 100 of FIG. 8A, the support mechanism 100 in FIG. 8B includes a channel 108 coupled to a first flap 202 and a flap overlap mechanism that overlaps a second flap 204. Furthermore, the support mechanism 100 may also include an attachment mechanism, such as a hook and loop fastener between the flap overlap mechanism and the second flap 204.

Figure 8C:
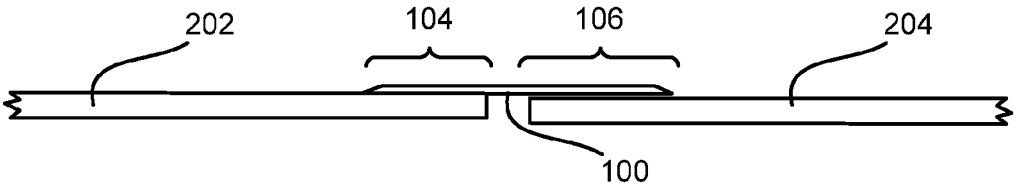

FIG. 8C illustrates a support mechanism 100 without a channel 108. The support mechanism 100 includes a container coupling mechanism 104 and an overlap portion 106. The container coupling mechanism 104 includes a surface which is coupled to the first flap 202. According to one embodiment, the support mechanism 100 is coupled to the first flap 202 using an adhesive between the support mechanism 100 and the first flap 202. According to one embodiment, the container coupling mechanism 104, prior to coupling, may include a peel back adhesive surface or strip where a material may be peeled back to reveal an adhesive which may be used to couple to a flap of a container 200. The container coupling mechanism 104 may include any other means for securing the support mechanism 100 to the first flap 202.

Similar to the previous embodiments, the support mechanism 100 may also include an attachment mechanism, such as a hook and loop fastener between the overlap portion 106 and the second flap 204. In another embodiment, the container coupling mechanism 104 may include posts or other protrusions (not shown) that may penetrate the first flap 202. For example, posts may extend through holes in the first flap 202. In a further embodiment, a strip of material may connect or snap to the posts on the bottom of the first flap 202 (not shown). One of skill in the art will recognize other ways for the container coupling mechanism 104 to connect to the first flap 202.

Figure 8D:
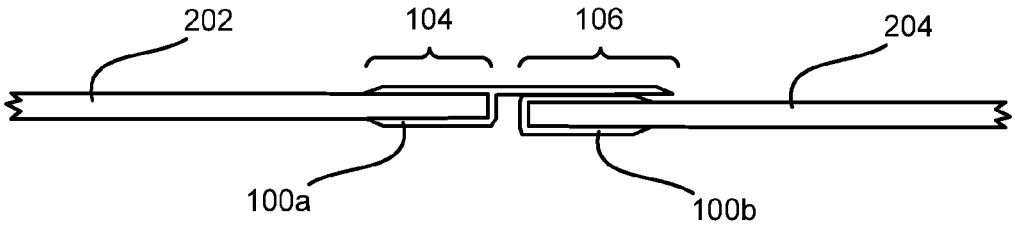

FIG. 8D illustrates a support mechanism 100 that includes a first piece 100*a* and a second piece 100*b*. The second piece 100*b* may be attached to the container 200 using an adhesive, an adhesive strip, a channel, a resistive fit, posts extending through the container 200, or any other means to secure the second piece 100*b* to the container 200. The first piece 100*a* includes a container coupling mechanism 104 coupled to a first flap 202 and an overlap portion 106 overlapping a second flap 204. The second piece 100*b* has a channel similar to the container coupling mechanism 104 of the first piece 100*a* and is coupled to a second flap 204. The support mechanism 100 may also include an attachment mechanism, such as a hook and loop fastener between the overlap portion 106 and the second flap 204. Other attachment mechanisms may also be used such as a magnet, button, adhesive, or resistive fit between the first piece 100*a* and the second piece 100*b*, or any other suitable attachment mechanism.

Figure 9A:
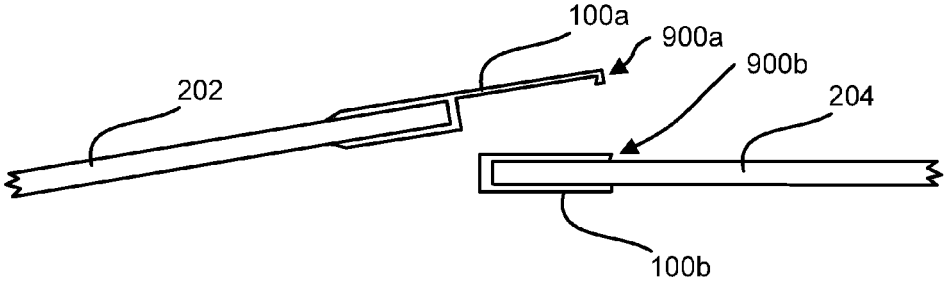
FIGS. 9A and 9B are cross-sectional side-views of one embodiment of a support mechanism that includes an attachment mechanism having a resistive fit in accordance with the present invention.
Figure 9B:
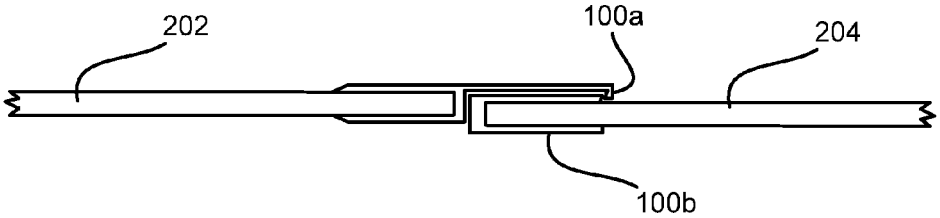

FIGS. 9A and 9D illustrate an exemplary two piece support mechanism 100 that includes one embodiment of a resistive fit between the first piece 100*a* and the second piece 100*b*. FIG. 9A illustrates the second flap 204 in a closed position and the first flap 202 not in a closed position. The support mechanism 100 is similar to that of FIG. 8D but also includes a resistive fit attachment mechanism that includes a first portion 900*a* and a second portion 900*b*. The first portion 900*a* and second portion 900*b* provide a resistive fit between the first piece 100*a* and the second piece 100*b* such that they snap into place when manipulated into a closed position. FIG. 9B illustrates the first flap 202 and the second flap 204 in closed positions with a resistive fit between the first portion 900*a* of the attachment mechanism on the first piece 100*a* and the second portion 900*b* of the attachment mechanism on the second piece 100*b*. The first portion 900*a* of the first piece 100*a* may include a lip that overlaps the second portion 900*b* of the attachment mechanism 402. The second portion 900*b* of the attachment mechanism 402 may include a recess and the lip may be shaped to fit in the recess to form a resistive fit in a closed position.

Figure 10A:
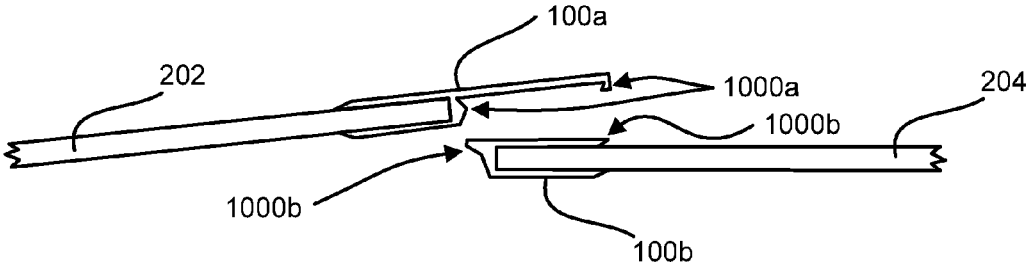
FIGS. 10A and 10B are cross-sectional side-views of another embodiment of a support mechanism that includes an attachment mechanism having a resistive fit in accordance with the present invention.
Figure 10B:
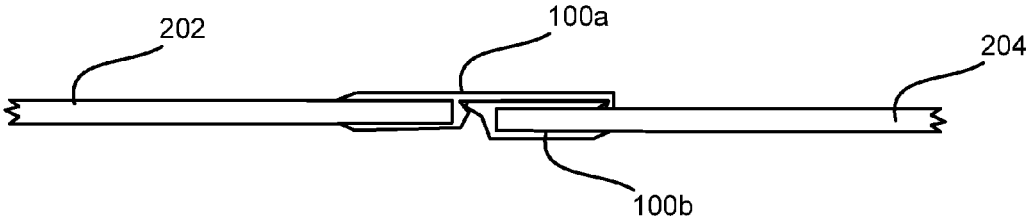

FIGS. 10A and 10D illustrate another exemplary two piece support mechanism 100 that includes a resistive fit between the first piece 100*a* and the second piece 100*b*. FIG. 10A illustrates the second flap 204 in a closed position and the first flap 202 not in a closed position. The support mechanism 100 is similar to that of FIG. 8D but also includes a resistive fit attachment mechanism that includes a first portion 1000*a* and a second portion 1000*b*. The first portion 1000*a* and second portion 1000*b* provide a resistive fit between the first piece 100*a* and the second piece 100*b* such that they snap into place when manipulated into a closed position. FIG. 10B illustrates the first flap 202 and the second flap 204 in closed positions with a resistive fit between the first portion 1000*a* of the attachment mechanism on the first piece 100*a* and the second portion 1000*b* of the attachment mechanism on the second piece 100*b*.

In more general terms, the first piece 100*a* includes a first portion 1000*a* shaped to receive a second portion 1000*b* of the second piece 100*b* in a closed position and the closed position is resistive to opening. The attachment mechanism 402 may include a hook and loop fastener (not shown) where the first portion 1000*a* of the first piece 100*a* is the hook side and the second portion 1000*b* of the second piece 100*b* is the loop side of the hook and loop fastener. Snaps, magnets, buttons, or other devices may be used as an attachment mechanism 402.

In other embodiments, the first portion 1000*a* of the first piece 100*a* is shaped to receive the second portion 1000*b* of the second piece 100*b* in a closed position where the closed position is resistive to opening. Any configuration that would snap together or provide a resistive fit and would hold the first piece 100*a* to the second piece 100*b* could be used as part of the attachment mechanism 402.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A support mechanism for a container, the support mechanism comprising:

a container coupling mechanism for coupling to a distal end of a first flap of the container, the container comprising at least a first flap and a second flap, the first flap and the second flap each comprising a hinge end and the distal end opposite the hinge end, the hinge end of the first flap connected to a first side of the container, the hinge end of the second flap connected to a second side of the container, the container coupling mechanism extending substantially along the distal end of the first flap from a third side of the container to a fourth side of the container, the third side and the fourth side perpendicular to the first side and the second side of the container, the first side, the second side, the third side, and the fourth side connected to form one of a rectangle and a square;

a flap overlap mechanism extending from the container coupling mechanism and overlapping the second flap when the first flap and the second flap are in a closed position such that the second flap is between an interior portion of the container and the flap overlap mechanism in the closed position with no portion of the flap overlap mechanism or the container coupling mechanism being between the second flap and the interior portion of the container, wherein a side of the flap overlap mechanism overlapping and facing the second flap is flat and is a uniform width, the width measured from the container coupling mechanism to an end distal to the container coupling mechanism; and an attachment mechanism that selectively maintains the first flap and the second flap in the closed position, wherein the attachment mechanism is detached from the container coupling mechanism and flap overlap mechanism and couples one or more of the first flap and the second flap to one or more of a third flap and a fourth flap, the third flap connected to the third side of the container and the fourth flap connected to the fourth side of the container, wherein the container coupling mechanism and flap overlap mechanism comprise a substantially rigid material of unitary construction extending along the distal end of the first flap from the third side to the fourth side such that the support mechanism supports a greater force applied in a direction normal to a plane formed by the first flap and second flap in the closed position than a force supported by the first flap and the second flap without the support mechanism.

2. The support mechanism of claim 1, wherein the container coupling mechanism and the flap overlap mechanism are made of one piece monolithic construction.

3. The support mechanism of claim 1, wherein the attachment mechanism comprises one or more of a hook and loop fastener;

a resistive fit mechanism;

an adhesive;

a button; and a magnet.

4. The support mechanism of claim 1, wherein the support mechanism comprises materials different from materials of the container.

5. The support mechanism of claim 1, wherein the support mechanism is coupled to the first flap after manufacturing of the container.

6. The support mechanism of claim 1, wherein the container coupling mechanism comprises a channel for securing the coupling mechanism to the distal end of the first flap.

7. The support mechanism of claim 1, wherein the container coupling mechanism comprises one or more of an adhesive;

an adhesive strip;

a hook and loop fastener; and a series of posts that extend through a flap of the container.

8. The support mechanism of claim 1, wherein the attachment mechanism comprises a first piece for coupling to the first flap and a second piece for coupling to the second flap.

9. The support mechanism of claim 8, wherein the attachment mechanism comprises one or more of a hook and loop fastener, a magnet and material attractive to the magnet, and a snap.

10. The support mechanism of claim 1, wherein the support mechanism comprises one or more of, plastic;

rubber;

metal; and vinyl.

11. The support mechanism of claim 1, wherein one or both of the container coupling mechanism and the flap overlap mechanism comprise a writeable surface.

12. A container system, the system comprising:

a container comprising at least a first flap and a second flap, the first flap and the second flap each comprising a hinge end and a distal end opposite the hinge end, the hinge end of the first flap connected to a first side of the container, the hinge end of the second flap connected to a second side of the container, a third side and a fourth side perpendicular to the first side and the second side of the container, the first side, the second side, the third side, and the fourth side connected to form one of a rectangle and a square;

a container coupling mechanism for coupling to the distal end of the first flap of the container, the container coupling mechanism extending substantially along the distal end of the first flap from the third side of the container to the fourth side of the container;

a flap overlap mechanism extending from the container coupling mechanism and overlapping the second flap when the first flap and the second flap are in a closed position such that the second flap is between an interior portion of the container and the overlap mechanism in the closed position with no portion of the flap overlap mechanism or the container coupling mechanism being between the second flap and the interior portion of the container, wherein a side of the flap overlap mechanism overlapping and facing the second flap is flat and is a uniform width, the width measured from the container coupling mechanism to an end distal to the container coupling mechanism; and an attachment mechanism that selectively maintains the first flap and the second flap in the closed position, wherein the attachment mechanism is detached from the container coupling mechanism and flap overlap mechanism and couples one or more of the first flap and the second flap to one or more of a third flap and a fourth flap, the third flap connected to the third side of the container and the fourth flap connected to the fourth side of the container, wherein the container coupling mechanism and flap overlap mechanism comprise a substantially rigid material of unitary construction extending along the distal end of the first flap from the third side to the fourth side such that the support mechanism supports a greater force applied in a direction normal to a plane formed by the first flap and second flap in the closed position than a force supported by the first flap and the second flap without the support mechanism.

13. The container system of claim 12, wherein the attachment mechanism comprises one or more of, a hook and loop fastener;

a resistive fit mechanism;

an adhesive;

a button; and a magnet.

14. The container system of claim 12, wherein the container coupling mechanism and the flap overlap mechanism are made of a one piece monolithic construction for coupling to the first flap and the attachment mechanism comprises a second piece for coupling to the second flap.

15. A container support kit, the container support kit comprising:

a support mechanism comprising a container coupling mechanism for coupling to a distal end of a first flap of the container, the container comprising at least a first flap and a second flap, the first flap and the second flap each comprising a hinge end and the distal end opposite the hinge end, the hinge end of the first flap connected to a first side of the container, the hinge end of the second flap connected to a second side of the container, the container coupling mechanism extending substantially along the distal end of the first flap from a third side of the container to a fourth side of the container, the third side and the fourth side perpendicular to the first side and the second side of the container, the first side, the second side, the third side, and the fourth side connected to form one of a rectangle and a square;

a flap overlap mechanism extending from the container coupling mechanism and overlapping the second flap when the first flap and the second flap are in a closed position such that the second flap is between an interior portion of the container and the flap overlap mechanism in the closed position with no portion of the flap overlap mechanism or the container coupling mechanism being between the second flap and the interior portion of the container, wherein a side of the flap overlap mechanism overlapping and facing the second flap is flat and is a uniform width, the width measured from the container coupling mechanism to an end distal to the container coupling mechanism; and an attachment mechanism that selectively maintains the first flap and the second flap in the closed position, wherein the attachment mechanism is detached from the container coupling mechanism and flap overlap mechanism and couples one or more of the first flap and the second flap to one or more of a third flap and a fourth flap, the third flap connected to the third side of the container and the fourth flap connected to the fourth side of the container; and instructions for connecting the support mechanism to the container, wherein the container coupling mechanism and flap overlap mechanism comprise a substantially rigid material of unitary construction extending along the distal end of the first flap from the third side to the fourth side such that the support mechanism supports a greater force applied in a direction normal to a plane formed by the first flap and second flap in the closed position than a force supported by the first flap and the second flap without the support mechanism.

16. The container support kit of claim 15, further comprising a hook and loop fastener.

* * * * *